US006663029B2

(12) United States Patent
Takano et al.

(10) Patent No.: US 6,663,029 B2
(45) **Date of Patent: *Dec. 16, 2003**

(54) APPARATUS FOR CRUSHING WASTE PRODUCTS AND METHOD OF OPERATING THE SAME

(75) Inventors: Hiroshi Takano, Kouka-gun (JP); Tetsushi Yonekawa, Otsu (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 74 days.

This patent is subject to a terminal disclaimer.

(21) Appl. No.: 09/996,680

(22) Filed: Nov. 30, 2001

(65) Prior Publication Data

US 2002/0056770 A1 May 16, 2002

Related U.S. Application Data

(62) Division of application No. 09/538,895, filed on Mar. 30, 2000, now Pat. No. 6,390,396.

(30) Foreign Application Priority Data

Oct. 1, 1999 (JP) ..... P 11-281378

(51) Int. Cl.[7] ..... B02C 25/00

(52) U.S. Cl. ..... 241/31; 241/33; 241/48; 241/79.1

(58) Field of Search ..... 241/30, 31, 36, 241/79.1, 38, 48, 33

(56) References Cited

U.S. PATENT DOCUMENTS

| | | | | |
|---|---|---|---|---|
| 1,135,594 A | | 4/1915 | Liggett | |
| 2,480,998 A | | 9/1949 | Brackett | |
| 4,226,371 A | | 10/1980 | Williams | |
| 5,887,806 A | * | 3/1999 | Onken | 241/31 |
| 6,076,752 A | | 6/2000 | Paradowski et al. | |

FOREIGN PATENT DOCUMENTS

| | | |
|---|---|---|
| JP | 6-226137 | 8/1994 |

* cited by examiner

*Primary Examiner*—Mark Rosenbaum
(74) *Attorney, Agent, or Firm*—Wenderoth, Lind & Ponack, L.L.P.

(57) ABSTRACT

A apparatus for crushing waste metal products includes a rotor having a crushing device on a periphery thereof and a casing enclosing the rotor. The casing has an inlet and an outlet for products to be crushed. An exhaust gas from the casing is partly returned to the inlet of the casing by a circulator. The rest of the exhaust gas is ventilated and processed by an exhaust processor. An oxygen concentration is monitored in a gas pathway of the circulator to control the gas concentration in the casing. If the oxygen concentration is high, a water shower sprays into the casing.

12 Claims, 5 Drawing Sheets

APPARATUS FOR CRUSHING WASTE PRODUCTS AND METHOD OF OPERATING THE SAME

This application is a Divisional of Ser. No. 09/538,895, filed Mar. 30, 2000. which is now U.S. Pat. No. 6,390,396

BACKGROUND OF THE INVENTION

1. Field of the Invention

The present invention relates to a rotary crusher for crushing waste metal products such as, for example, compressors, air conditioners or refrigerators, particularly those containing combustibles. More particularly, the invention relates to the rotary crusher in which exhausted smoke can easily be treated and in which gas concentration can be precisely monitored to prevent an explosion.

2. Description of the Prior Art

In the conventional recycling of wasted metal products including iron and copper, the products are broken into adequate size and then the iron and copper materials are separated therefrom by, for example, a magnetic separation technique. In crushing the waste metal products, a rotary crusher is generally used to facilitate the subsequent separation process. The rotary crusher has a rotor with hammers mounted on its periphery so that the waste products can be crushed while being compressed by the hammers.

If the crusher breaks oil-containing metal wastes such as compressors, smoke arises in the crusher. The smoke travels having ridden on an airflow generated by rotation of the rotor and then emerges from an outlet of the crusher together with crushed pieces. Therefore, an exhaust processor having a ventilation fan is generally placed near the outlet of the crusher in order to collect the smoke.

When metal wastes containing a flammable material such as oil is crushed, explosion may occur. Accordingly, the crusher needs an explosion-proof system. Hitherto, the explosion-proof system is implemented by, for example, blowing inert gas or water vapor into the crusher according to the concentration of oxygen in the crusher that is detected by an oxygen sensor to maintain the oxygen concentration under the explosion limit. Such an explosion-proof system is disclosed in, for instance, Japanese laid-open patent publication H6-226137.

However, the conventional rotary crusher has the following drawbacks:

(1) In order to vent the exhausted smoke from the crusher completely, the inlet capacity of the ventilation fan must be greater than the exhaust capacity of the crusher. Accordingly, increase of the exhaust capacity of the crusher by, for example, increasing the speed of rotation of the rotor results in necessity of use of the suction ventilation fan having a higher inlet capacity. This in turn increases the size of the exhaust processor. Also, the exhaust processor with such a high inlet capacity fan may draw in light-weight pieces such as, for example, insulating paper or copper together with the smoke. The pieces caught by the fan do not only bring about clogging of the fan, but also reduce the waste recycling efficiency.

(2) The concentration of oxygen or flammable gas near a crushing point should be precisely monitored by, for example, an oxygen sensor to prevent explosion from taking place during crushing. When the oxygen sensor is placed in the crusher, the sensor should be disposed in a recess or protected with a cover to avoid its breakdown by collision with the crushed pieces. However, since the air stream is apt to stay in the recess or in the cover, the gas concentration tends to become uneven. Therefore, in the conventional crusher, an accurate measurement of the oxygen concentration has been difficult to achieve.

(3) When the explosion-proof means such as introduction of inert gas or water vapor is employed, pipes and nozzles must be installed in the crusher to introduce the gas. This complicates the construction of the crusher.

SUMMARY OF THE INVENTION

It is accordingly an object of the present invention to provide an apparatus, and a method of operating such apparatus, for crushing products containing flammable material, in which an exhausted smoke can easily be processed and in which gas concentration can be precisely monitored to prevent an explosion.

Another object of the present invention is to provide a recycling system that has a high recycling efficiency and that is safely operable.

In accordance with a first aspect of the present invention, a crushing apparatus comprises:

a rotor having a crushing means on a periphery thereof;

a casing for enclosing said rotor, the casing having an inlet and an outlet for materials to be crushed;

exhaust-circulating means for returning a part of exhaust gas from the outlet to the inlet of said casing; and exhaust-processing means for ventilating and processing the exhaust gas exhausted from said casing.

The advantage of this invention is the ability to reduce the exhaust capacity of the crusher casing. This downsizes the exhaust-processing section of the apparatus and prevents the exhaust-processing section from sucking light-weight crushed pieces, thereby allowing a smooth operation of the crushing apparatus.

Preferably, the crushing apparatus comprises a gas sensor disposed in a gas pathway of said exhaust-circulating means. This arrangement makes it possible to measure accurately a gas concentration in the crusher casing.

Further, the crushing apparatus preferably comprises water-supply means for supplying water according to an output signal from said gas sensor in the gas pathway or near a terminal of the gas pathway of said exhaust-circulating means. By arranging the water supplier in such a manner, an explosion during crushing can be prevented with simple construction.

More preferably, the crushing apparatus comprises a crushed-piece sensor for detecting pieces sucked by said exhaust-processing means, an outlet smoke sensor for detecting leaked smoke without being sucked by said exhaust-processing means, and an inlet smoke sensor for detecting leaked smoke from the inlet of said casing of the apparatus. These sensors facilitate smooth operation of the crushing apparatus.

In accordance with another aspect of the present invention, method of operating the crushing apparatus is characterized in that:

if the crushed-piece sensor detects the crushed pieces, an inlet capacity of said exhaust-processing means is reduced until said crushed-piece sensor does not detect the pieces, but;

if the outlet-smoke sensor detects the smoke, a circulating capacity of said exhaust-circulating means is increased to within a range in which said inlet-smoke sensor does not detect the smoke.

In this manner, the smoke leakage from the inlet and outlet of the crusher casing is minimized, so that suction of the crushed pieces by the exhaust-processing means is prevented.

Preferably, if the gas concentration measured by the gas sensor is higher than a predetermined value, the water-supply means operates. This infallibly prevents an explosion which would otherwise occur in the crusher.

More preferably, if the gas concentration measured by the gas sensor is still higher than the predetermined value after a predetermined period from the start of operation of the water-supply means, the crushing apparatus stops operating. This further lowers the possibility of occurrence of the explosion.

In accordance with still another aspect of the present invention, a waste-recycling system comprises:

a crushing apparatus of the present invention;

a transport means for transporting crushed pieces exhausted from said crushing apparatus; and a magnetic separator disposed above said transport means to collect ferrous components from the crushed pieces. In the waste-recycling system, suction of the crushed pieces by the exhaust-processing means is prevented. Accordingly, the waste-recycling system is smoothly operative and has a high recycling efficiency. Also, since a precise forecast of an explosion is possible, the system can be operated safely.

BRIEF DESCRIPTION OF THE DRAWINGS

The above and other object and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

The application is based on an application No. 11-281378 filed in Japan, the content of which is incorporated herein by reference.

Figure 1:
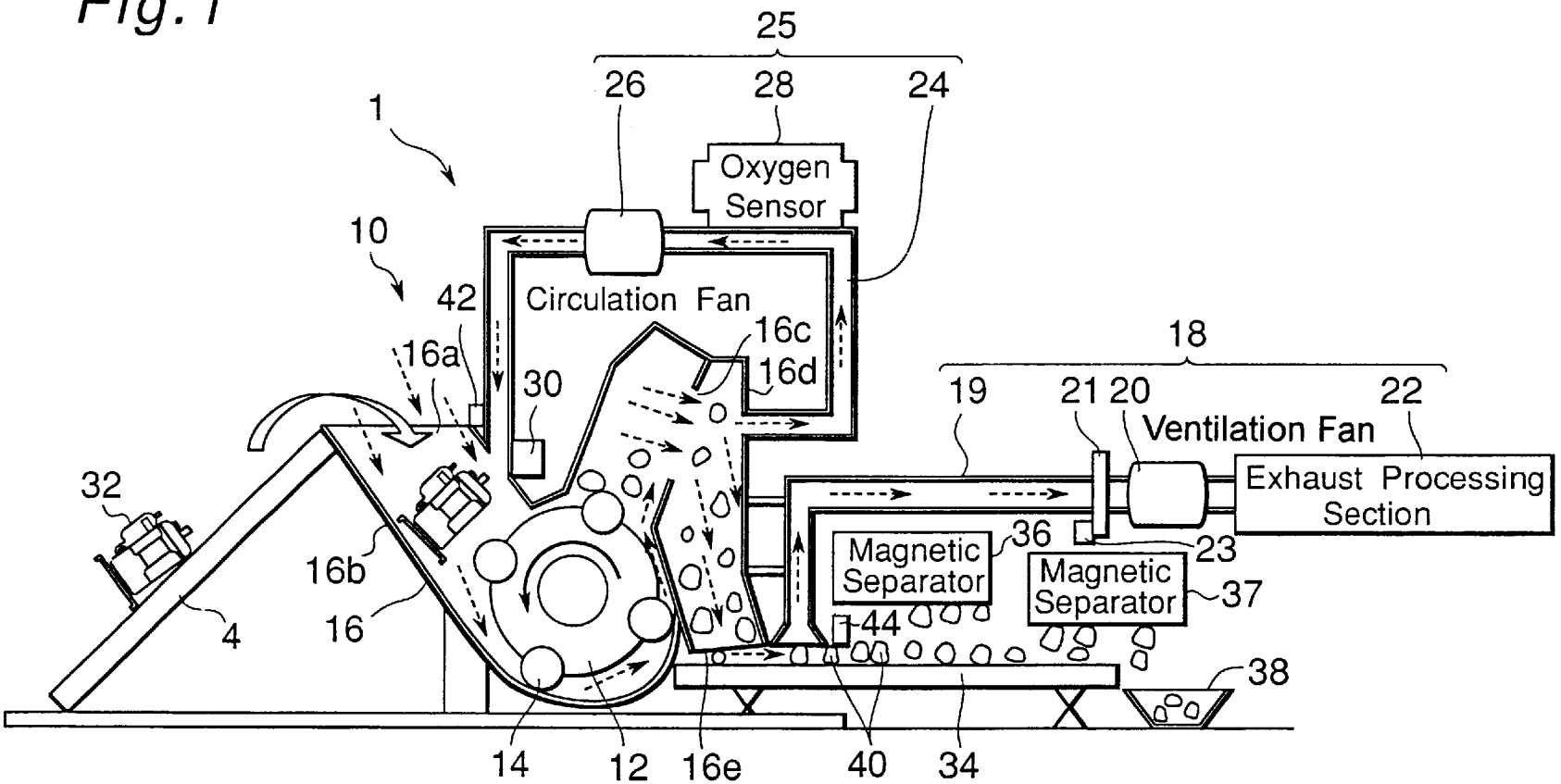
FIG. 1 is a schematic diagram of a waste-recycling system including a rotary crusher of the present invention.

Referring to FIG. 1, a waste-recycling system 1 includes a feeder 4, a rotary crusher 10, a transporter 34 which is, for example, a vibrating conveyer, magnetic separators 36 and 37, and a receiving box 38. The waste-recycling system 1 operates as follows. First, the feeder 4 supplies metal wastes 32 such as compressors to the rotary crusher 10, in which the wastes 32 are crushed into pieces 40. The transporter 34 transports the crushed pieces 40 discharged from the crusher 10, and the magnetic separators 36 and 37 magnetically separate the pieces 40 into ferrous and non-ferrous elements. The box 38 receives the non-ferrous pieces that are not salvaged by the magnetic separators 36 and 37.

The crusher 10 includes a rapidly rotating rotor 12 having breaking means 14 such as hammers or cutters on its periphery; a casing 16 enclosing the rotary crusher 10; an exhaust processor 18; and an exhaust circulator 25. The metal wastes 32 supplied from an inlet 16*a* travel through an injection chute 16*b* towards the rotor 12. The wastes 32 are compressed and shorn into pieces 40 between the rotating hammers 14 and fixed cutters (not shown) that are arranged on the casing 16 around the rotor 12. The crushed pieces 40 pass through a gate 16*c* and an ejection chute 16*d* and then emerge from the outlet 16*e*.

When the metal wastes (e.g. a compressor) 32 are oil-loaded products such as compressors, oil in the wastes 32 must be removed before they are thrown into the crusher 10. However, the oil sticking to and/or wetting inner wall surfaces of the metal wastes is difficult to remove completely, and therefore, a small quantity of oil usually remains in the compressor 32 when the latter is supplied to the crusher 10.

If the wastes include oil even in a small quantity, smoke is generated by impact and friction that occur during crushing. In the rotary crusher 10, a high-speed rotation of the rotor 12 carrying the hammers 14 produces an air stream flowing from inlet 16*a* to outlet 16*e*. By the air stream, the generated smoke is exhausted from outlet 16*e* together with the crushed pieces 40.

In order to vent and process the smoke, the exhaust-processor 18 is installed near the outlet 16*e*. The exhaust processor 18 draws in the smoke via a duct 19 with a ventilation fan 20 to process the smoke in an exhaust processing section 22 by, for example, adsorption. To absorb the smoke completely, an inlet capacity of the ventilation fan 20 must be greater than an exhaust capacity of the crusher 10. However, excessive increase of the inlet capacity of the exhaust processor 18 results in inhaling of light-weight pieces such as insulated papers or cupric scraps by the processor 18. If a large amount of light-weight pieces are drawn in, a filter 21 in the exhaust processor is quickly clogged and, as a result, requires frequent replacement or cleaning. This prevents smooth operating of the crusher 10 and lowers its recycling efficiency.

In order to substantially eliminate such an unfavorable influence, it is preferable to lower the exhaust capacity of the crusher 10. However, the exhaust capacity of the crusher 10 depends on a rotating rate of the hammer 14, which rate relates to a crushing ability of the crusher 10. Therefore, the exhaust capacity cannot be simply decreased. According to the present invention, a part of the exhaust from the casing 16 is returned to the inlet side of the rotor in the casing 16 by an exhaust (circulator an exhaust-circulating means) 25, so that the exhausting capacity of the crusher 10 is reduced while keeping its crushing ability. For example, a circulation duct 24 having circulation fan 26 is connected to the ejection chute 16*d* and the injection chute 16*b*. The circulation duct 24 returns a part of the exhaust from the ejection chute 16*d* to the injection chute 16*b*. This reduces the exhaust capacity of the crusher 10.

The circulation duct 24 is preferably placed above the gate 16*c* so that the crushed pieces do not irrupt into the duct 24. If the circulation duct 24 and the inhalation duct 24 are disposed so as to cooperate with each other in inhaling the exhausted smoke, different arrangements from that in FIG. 1 may be employed. For example, the circulation duct 24 may be connected to the inhalation duct 19 before the ventilation fan 20 instead of being connected to the ejection chute 16*d*. Further, the inhalation duct 19 may be connected directly to the ejection chute 16*d* instead of being placed adjacent to the outlet 16*e*.

In order to prevent an explosion that may occur while crushing wastes including flammable material such as oil, the crusher 10 of this embodiment has an oxygen sensor (a gas sensor) 28 in the gas pathway of the circulation duct 24 to monitor an oxygen concentration in the circulation duct 24. Alternatively, a gas sensor sensing a concentration of flammable material may be used. The oxygen sensor 28 can measure an accurate concentration of the oxygen, because the airflow does not stay in the circulation duct 24 and the oxygen sensor does not have a protecting cover on it. Since the air passing through the circulation duct 24 is blown into the casing 16, the oxygen concentration in the duct 24 reflects that in the casing 16. Preferably, the circulation duct 24 is connected near the point where the hammers 14 initially contact with the fixed cutter so that the oxygen concentration in the circulation duct 24 truly reflects the oxygen concentration near the first impacting point of the hammers 14. Since the explosion is apt to occur at that first impacting point, the explosion occurrence may be precisely predicted by monitoring the oxygen concentration at that point. When the oxygen concentration in the circulation duct 24 increases over a limit value that is predetermined in reference to the lowest possible concentration oxygen at which the flammable material may explode, a water-shower device (a water-supply means) 30 starts to spray water. The wind generated by the circulation fan 26 carry the sprayed water into the casing 16 to rise the water concentration. Increase of the water concentration in the casing 16 lowers the oxygen concentration therein. If the oxygen concentration is lowered under the limit value corresponding to the lowest possible concentration oxygen at which the flammable material may explode, the explosion will not occur. As long as the wind by the fan 26 can carry the water into the casing 16, the water shower 30 may be disposed at different places. For example, the shower 30 may be placed near the terminal of the circulation duct 24. By using the water shower 30, the water concentration in the casing 16 can be controlled without installing pipes and nozzles for introducing the water vapor in the casing 16.

Figure 2:
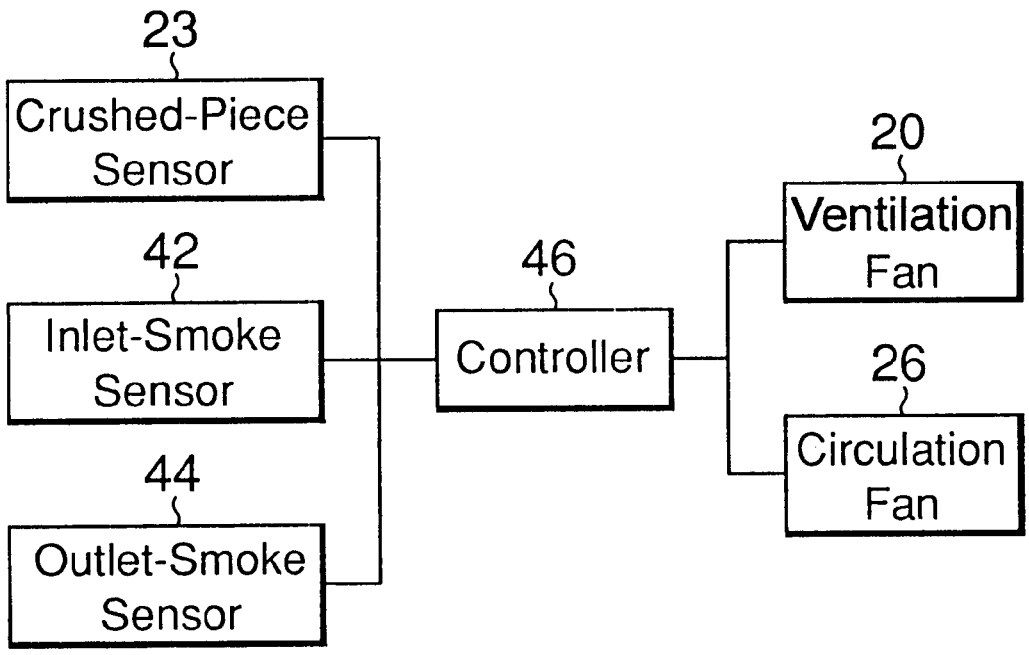
FIG. 2 is a block diagram showing a control system for controlling ventilating fan and an exhaust-circulating fan.

Hereinafter, an example of an operating method of the rotary crusher 10 according to the present invention will now be described. First, the controlling method of the ventilation fan 20 and the circulation fan 26 to minimize a smoke leak from the outlet 16*e* is described. FIG. 2 is a block diagram showing a controlling system for controlling the ventilation fan 20 and the circulation fan 26. A controller 46 is electrically connected to a crushed-piece sensor 23 for detecting pieces stuck on the filter 21 in the exhaust processor 18; an inlet-smoke sensor 42 for detecting leaked smoke from the inlet 16*a* of the casing 16; and an outlet-smoke sensor 44 for detecting smoke leaked from the outlet 16*e* of the casing 16 that has not been inhaled by the exhaust processor 18. For example, a photo sensor may be utilized as the crushed-piece sensor 23, the inlet-smoke sensor 42 or the outlet-smoke sensor 44.

Figure 3:
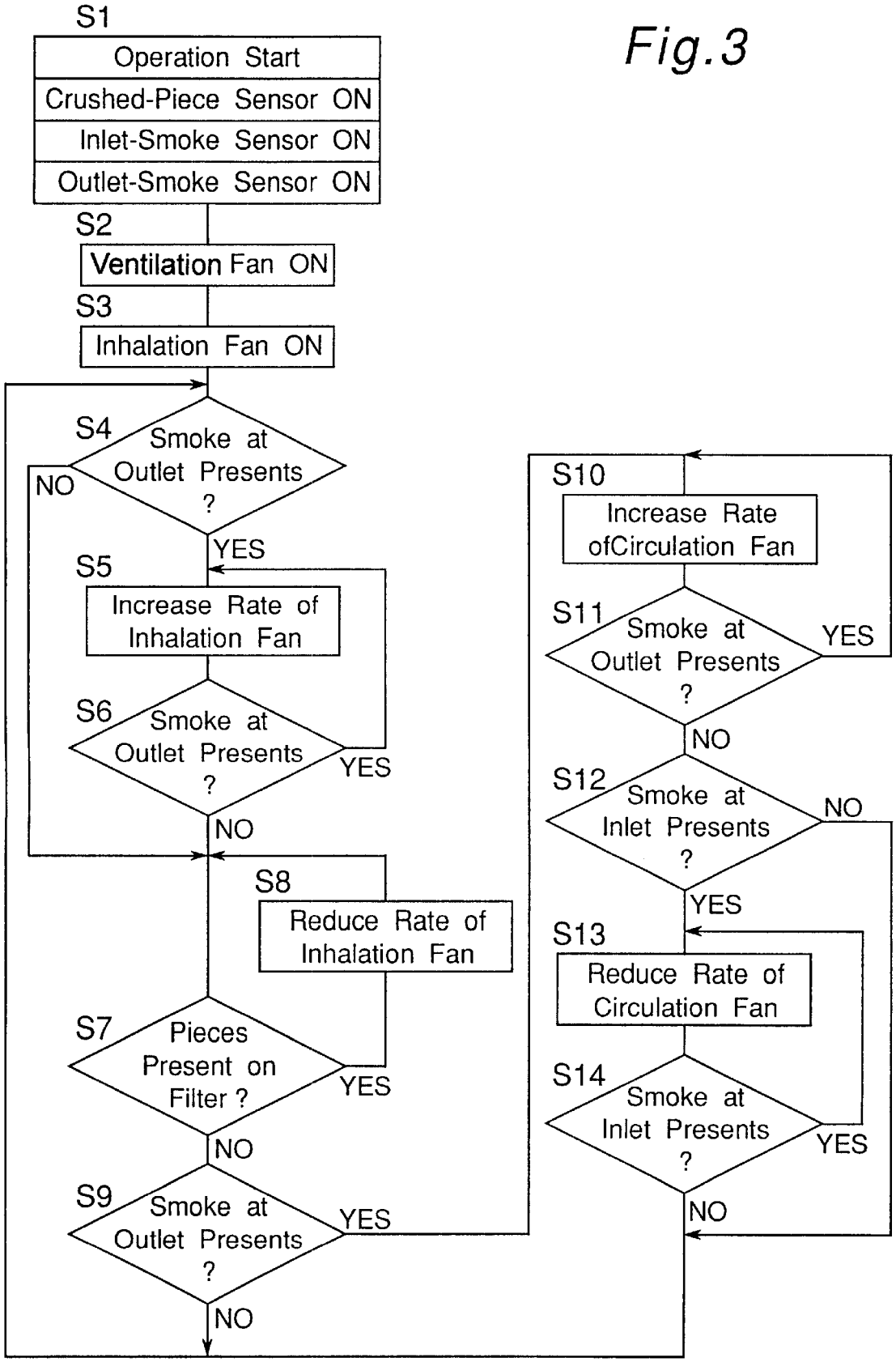
FIG. 3 is a flowchart showing a controlling procedure of the exhaust-ventilation fan and the exhaust-circulating fan.

FIG. 3 is a flowchart showing the controlling method of the ventilation fan 20 and the circulation fan 26. At step S1, the crusher 10 starts operating, and the crushed-piece sensor 23, the inlet-smoke sensor 42 and the outlet-smoke sensor 44 are activated. At step S2 and step S3, the circulation fan 26 and the ventilation fan 20 start operating, respectively. At step S4, the determination is made whether the smoke leaks or not from the outlet 16*e* by signals from the outlet-smoke sensor 44. If the smoke has not been detected, the procedure advances to step S7, and if the smoke has been detected, the procedure advances to step S5 at which the rotation speed of the ventilation fan 20 is increased by a predetermined value. At subsequent step S6, if the smoke is still detected, the procedure returns to step S5, while if the smoke is no longer detected, the procedure advances to step S7.

At step S7, in order to prevent the exhaust processor 18 from inhaling light-weight crushed pieces such as insulation sheets and cupric scraps, the determination is made whether crushed pieces are stuck or not on the filter 21 in the exhaust processor 18. If no crushed piece is detected, the procedure advances to step S9. In contrast, if the crushed piece has been detected, the procedure advances to step S8 at which the rotation speed of the ventilation fan 20 is reduced by a predetermined value. The step S7 and the step S8 are repeated until new sticking of the crushed pieces is no longer detected.

At step S9, the determination is made again whether the smoke leaks or not from the outlet 16*e*. If the smoke has not been detected, the procedure returns to step S4, while if the smoke has been detected, the procedure advances to steps S10–S14 at which the smoke leakage from the outlet 16*e* is suppressed by adjusting the rotation speed of the circulation fan 26.

Steps S10–S14 will be described in detail. First, at step S10, the rotation speed of the circulation fan 26 is increased by a predetermined value. At subsequent step S11, if the smoke leakage from the outlet 16*e* is still detected, the procedure returns to step S10, while if the smoke leakage is no longer detected, the procedure advances to step S12. At step S12, the determination is made whether the smoke leaks or not from the inlet 16*a* by the inlet-smoke sensor 42. If the smoke is not detected, the procedure returns to step S4, while if the smoke is detected, the procedure advances to step S13 at which the rotation speed of the circulation fan 26 is reduced by a predetermined value. At subsequent step S14, if the smoke leakage from the inlet 16*a* is still detected, the procedure returns to step S13, while if the smoke leakage is not detected the procedure returns to step S4. The reason why judgement is made of the presence of the smoke leakage from the inlet 16*a* is that excess returning of the exhaust to the inlet side of the casing 16 may cause a backflow in the casing 16*a* which results in smoke leakage from the inlet 16*a*.

By operating the crusher 10 in this manner, the smoke leakage from the inlet 16*a* and the outlet 16*e* can be minimized while preventing the inhaling of the light-weight pieces by the exhaust processor 18.

Figure 4:
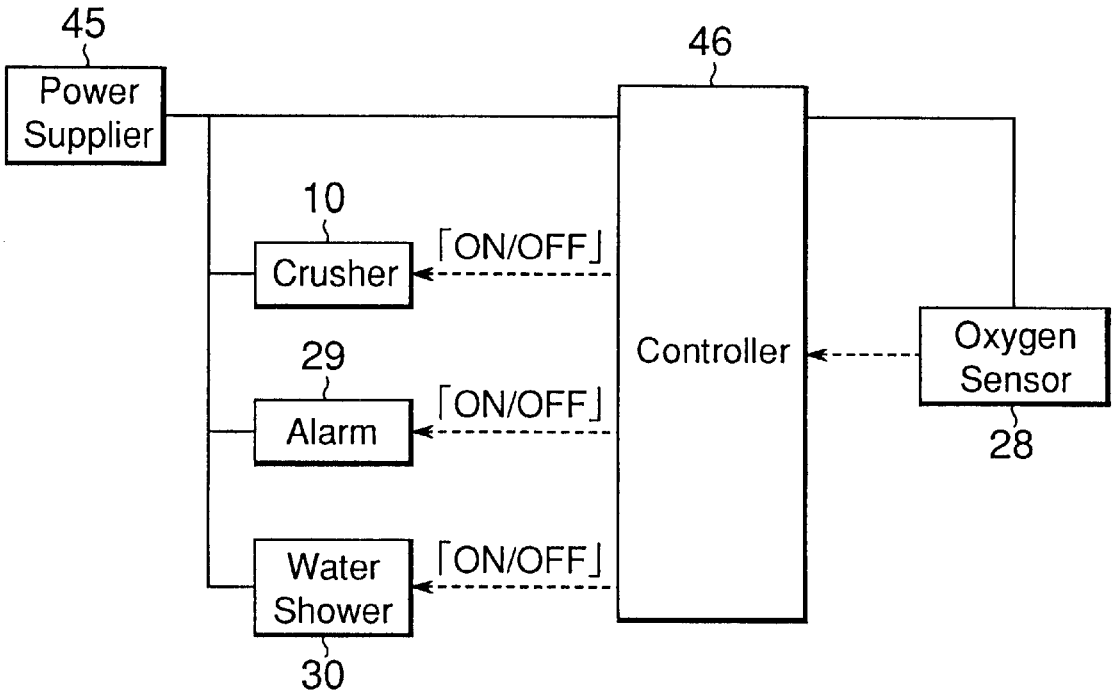
FIG. 4 is a block diagram showing a control system for controlling a water-shower device.

The controlling method of the water-shower device for preventing an explosion in the rotary crusher 10 will be described. FIG. 4 is a block diagram showing a control system for controlling the water-shower device and other devices. A controller 46 is electrically connected to the oxygen sensor 28, the crusher 10, an alarm 29 and the water-shower device 30. A power supplier 45 supplies electric power to all of these devices.

Figure 5:
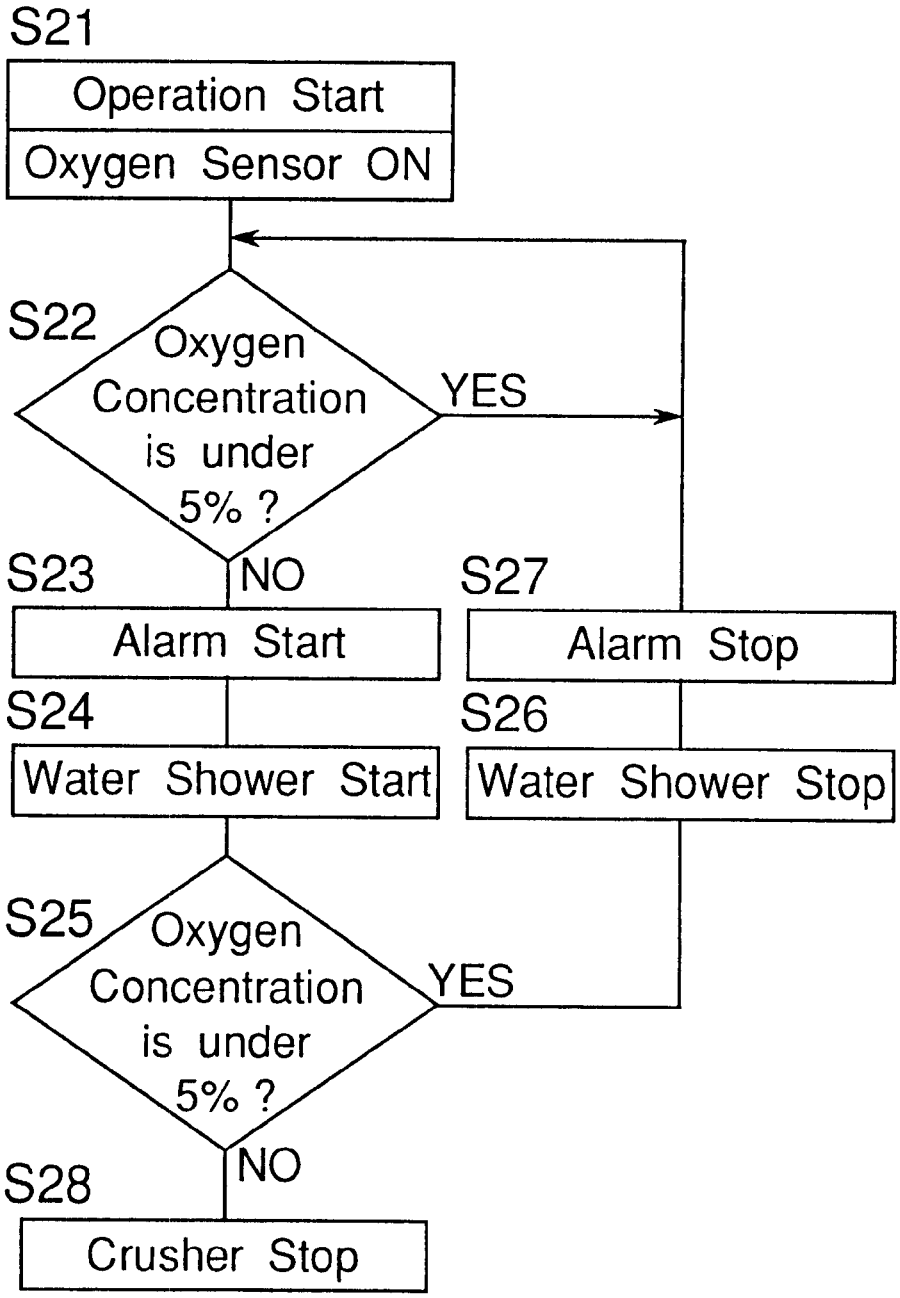
FIG. 5 is a flowchart showing a controlling procedure of the water-shower device.
Figure 3:
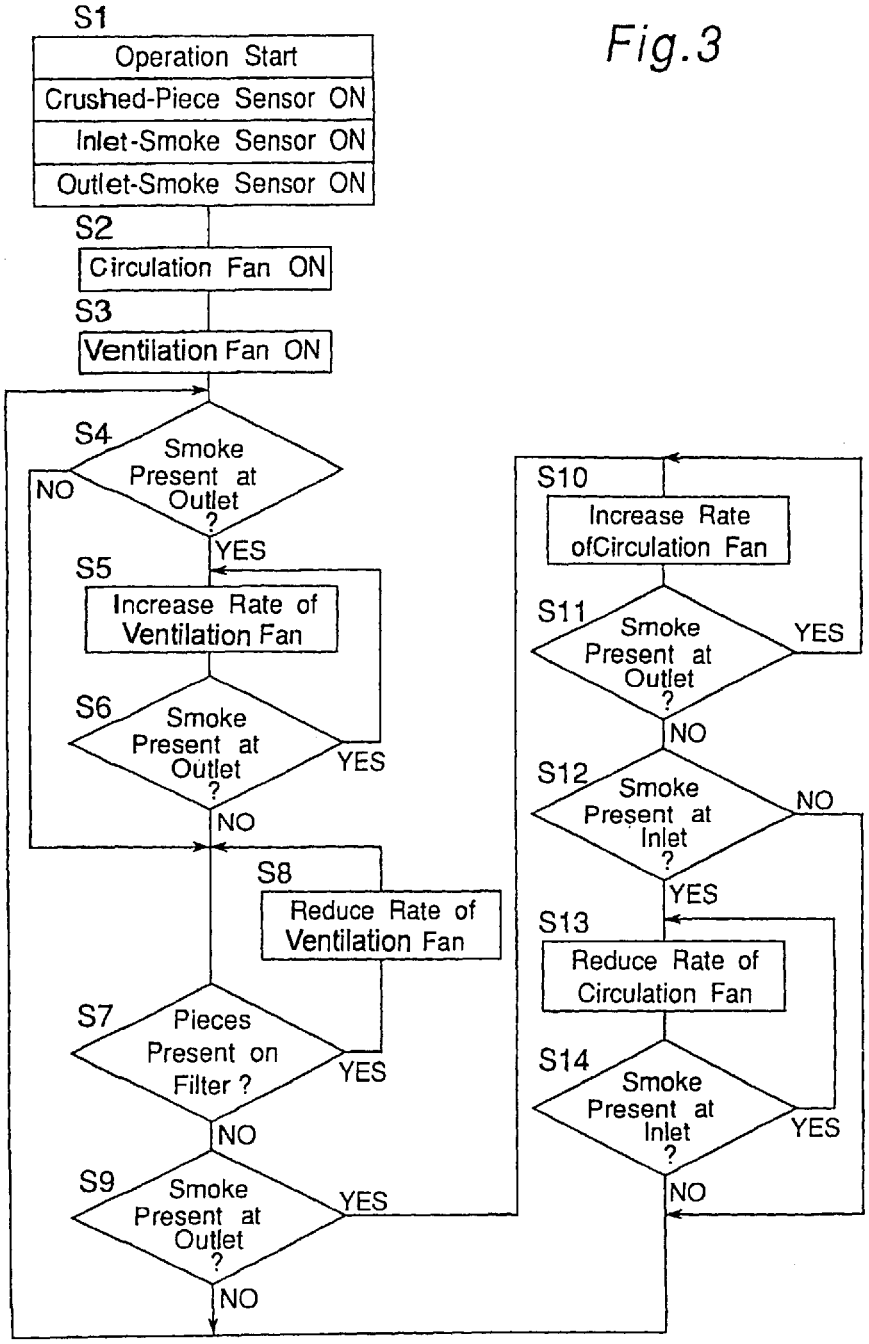

FIG. 5 is a flowchart showing the controlling method of the water-shower device 30 and other devices. First, at step S21, the rotary crusher 10 starts operating and the oxygen sensor 28 is activated. At step S22, the oxygen concentration in the circulation duct is determined. If the oxygen concentration is less than 5%, monitoring of the oxygen concentration is continued. In contrast, if the oxygen concentration is over 5%, the procedure advances to step S23, at which the alarm 29 is activated, and subsequently advances to step S24 at which the water-shower device 30 starts spraying. The spraying of the water increases the water concentration in the crusher 10 to reduce the oxygen concentration therein relatively.

When a predetermined time has passed from the operation start of the water-shower 30, the procedure advances to step S25. At step S25, if the oxygen concentration in the circulation duct 24 has been reduced under 5%, the procedure advances to step S26 at which the water-shower device stops spraying and further advances to step S27 at which the alarm 29 stops. Then, the procedure returns to step S22 at which the monitoring of the oxygen concentration is continued. In contrast, if the oxygen concentration has not been reduced under 5% at step S25, the procedure advances to step S28 at which the crusher 10 stops operating because the possibility of explosion is quite high.

In this manner, the oxygen concentration in the circulation duct 10 is kept under 5%, so that the atmosphere in the crusher 10 is kept out of an explosion region of the flammable gas generated from oil. The explosion threshold of the oxygen concentration depends on the kind of the flammable gas. Accordingly, the limit value of the oxygen concentration (in this example, 5%) must be adjusted according to the kind of oil in the wastes 32. When a flammable gas sensor is employed instead of the oxygen sensor 28, a similar control method can be applied. In such a case, the limit value of the flammable gas concentration is determined according to the explosion limit of the flammable gas.

EXAMPLE

In the rotary crusher shown in FIG. 1, an inverter-driven fan having a capacity of 130 $M^3$/min and a head 630 mmAq was adopted as the ventilation fan 20. Varying the specification of the circulation fan 26, the change of gas capacity at the inlet 16*a* and the outlet 16*e* was measured. Also, the change of the driving frequency of the ventilation fan 20 required to inhale all of the smoke exhausted from the outlet 16*e* was measured.

Comparative Example

When the circulation fan 26 was stopped and the circulation duct 24 was closed, the gas capacity at the inlet 16*a* and the outlet 16*e* was 16 $M^3$/min and 59 $M^3$/min, respectively. The inverter frequency of the ventilation fan 20 required to inhale all the smoke was 50 Hz.

Example 1

When the capacity and head of the circulation fan was 70 $M^3$/min and 50 mmAq, the gas capacity at the inlet 16*a* and the outlet 16*e* was reduced to 13.6 $M^3$/min and 44 $M^3$/min, respectively. The inverter frequency of the ventilation fan to inhale all the smoke was reduced to 45 Hz.

Example 2

When the capacity and head of the circulation fan was 125 $M^3$/min and 35 mmAq, the gas capacity at the inlet 16*a* and the outlet 16*e* was reduced to 12 $M^3$/min and 39 $M^3$/min, respectively. The inverter frequency of the ventilation fan to inhale all the smoke was reduced to 35 Hz.

These results are summarized in Table 1. In Table 1, the parenthesized values indicate a percentage expression of the gas capacity and the inverter frequency when those in the comparative example are taken as 100%.

TABLE 1

| | Specification of Circulation Fan | Gas Capacity at Inlet | Gas Capacity at Outlet | Inverter Freq. of Inhalation Fan |
|---|---|---|---|---|
| Comparative Example | 0 $M^3$/min<br>0 mmAq | 16 $M^3$/min<br>(100%) | 59 $M^3$/min<br>(100%) | 50 Hz<br>(100%) |

TABLE 1-continued

| | Specification of Circulation Fan | Gas Capacity at Inlet | Gas Capacity at Outlet | Inverter Freq. of Inhalation Fan |
|---|---|---|---|---|
| Example 1 | 70 $M^3$/min<br>50 mmAq | 13.6 $M^3$/min<br>(85%) | 44 $M^3$/min<br>(75%) | 45 Hz<br>(90%) |
| Example 2 | 125 $M^3$/min<br>35 mmAq | 12 $M^3$/min<br>(75%) | 39 $M^3$/min<br>(60%) | 35 Hz<br>(70%) |

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A crushing apparatus for crushing waste products that include oil, said apparatus comprising:

a rotor having a crushing device on a periphery thereof;

a casing for enclosing said rotor, said casing having an inlet and an outlet for materials to be crushed and a gate for the crushed materials disposed between said rotor and said outlet;

an exhaust circulator for returning a part of exhaust gas from the outlet to the inlet side of said casing, said exhaust circulator having a gas inlet that is located above the gate of said casing; and an exhaust processor for suctioning and processing the exhaust gas exhausted from casing.

2. The crushing apparatus according to claim 1, further comprising a gas sensor disposed in a gas pathway of said exhaust-circulator.

3. The crushing apparatus according to claim 2, further comprising a water-supply device for supplying water according to an output signal from said gas sensor.

4. The crushing apparatus according to claim 3, wherein said water-supply device is disposed in the gas pathway of said exhaust-circulator.

5. The crushing apparatus according to claim 3, wherein said water-supply device is disposed near a terminal of the gas pathway of said exhaust-circulator.

6. A crushing apparatus for crushing waste products that include oil, said apparatus comprising:

a rotor having a crushing device on a periphery thereof;

a casing for enclosing said rotor, said casing having an inlet and an outlet for materials to be crushed;

an exhaust circulator for returning a part of exhaust gas from the outlet to the inlet side of said casing; and an exhaust processor for suctioning and processing the exhaust gas exhausted from said casing, said exhaust processor having a duct for suctioning the exhaust gas from the outlet of said casing, wherein said exhaust circulator is connected to the duct of said exhaust processor.

7. The crushing apparatus according to claim 6, further comprising a gas sensor disposed in a gas pathway of said exhaust-circulator.

8. The crushing apparatus according to claim 7, further comprising a water-supply device for supplying water according to an output signal from said gas sensor.

9. The crushing apparatus according to claim 8, wherein said water-supply device is disposed in the gas pathway of said exhaust-circulator.

10. The crushing apparatus according to claim 8, wherein said water-supply device is disposed near a terminal of the gas pathway of said exhaust-circulator.

11. A waste-recycling system comprising:

a crushing apparatus for crushing waste products including oil, said apparatus comprising (1) a rotor having a crushing device on a periphery thereof, (2) a casing enclosing said rotor, said casing having an inlet and an outlet for materials to be crushed and a gate for the crushed materials, the gate being disposed between said rotor and said outlet, (3) an exhaust circulator for returning a part of exhaust gas from the outlet to the inlet side of said casing, said exhaust circulator being located above the gate of said casing, and (4) an exhaust processor for suctioning and processing the exhaust gas exhausted from said casing;

a transport device for transporting crushed pieces exhausted from said crushing apparatus; and a magnetic separator disposed above said transport means to collect ferrous components from the crushed pieces.

12. A waste-recycling system comprising:

a crushing apparatus for crushing waste products including oil, the apparatus comprising (1) a rotor having a crushing device on a periphery thereof, (2)a casing for enclosing said rotor, the casing having an inlet and an outlet for materials to be crushed, (3) an exhaust circulator for returning a part of exhaust gas from the outlet to the inlet side of said casing, and (4) an exhaust processor for suctioning and processing the exhaust gas exhausted from said casing, said exhaust processor having a duct for suctioning the exhaust gas from the outlet for said casing, wherein said exhaust circulator is connected to the duct of said exhaust processor;

a transport device for transporting crushed pieces exhausted from said crushing apparatus; and a magnetic separator disposed above said transport means to collect ferrous components from the crushed pieces.

* * * * *

UNITED STATES PATENT AND TRADEMARK OFFICE

CERTIFICATE OF CORRECTION

PATENT NO. : 6,663,029 B2
DATED : December 16, 2003
INVENTOR(S) : Hiroshi Takano et al.

It is certified that error appears in the above-identified patent and that said Letters Patent is hereby corrected as shown below:

Drawings,
Fig. 3, replace with Fig. 3 attached hereto.

Signed and Sealed this

Twenty-first Day of September, 2004

JON W. DUDAS
*Director of the United States Patent and Trademark Office*